US007310978B2

(12) United States Patent
Hisano

(10) Patent No.: US 7,310,978 B2
(45) Date of Patent: Dec. 25, 2007

(54) DRUM-TYPE WASHING MACHINE WITH ELASTIC OIL DAMPER

(75) Inventor: Kouji Hisano, Nagoya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 494 days.

(21) Appl. No.: 10/332,961

(22) PCT Filed: May 20, 2002

(86) PCT No.: PCT/JP02/04868

§ 371 (c)(1),
(2), (4) Date: Jan. 14, 2003

(87) PCT Pub. No.: WO02/095119

PCT Pub. Date: Nov. 28, 2002

(65) Prior Publication Data

US 2004/0016266 A1 Jan. 29, 2004

(30) Foreign Application Priority Data

May 23, 2001 (JP) ..... 2001-153890

(51) Int. Cl.
*D06F 37/20* (2006.01)
*D06F 35/00* (2006.01)

(52) U.S. Cl. ..... 68/23.1; 188/266

(58) Field of Classification Search ..... 68/12.06, 68/23.1, 23.2, 24; 188/266, 322.2
See application file for complete search history.

(56) References Cited

U.S. PATENT DOCUMENTS 4,318,535 A * 3/1982 Imai ..... 267/226
5,720,473 A * 2/1998 Thomas ..... 267/221
5,950,996 A * 9/1999 Pradel ..... 267/221
6,070,863 A * 6/2000 Pradel ..... 267/221
6,260,832 B1 * 7/2001 Vignocchi et al. ..... 267/64.15

FOREIGN PATENT DOCUMENTS

DE 1 938 536 2/1970
DE 4440653 A1 * 5/1996
DE 196 55 013 A1 1/1999
FR 2013990 * 4/1970

(Continued)

OTHER PUBLICATIONS

Electronic translation of FR 2013990.*

*Primary Examiner*—Joseph L. Perrin
(74) *Attorney, Agent, or Firm*—Pillsbury Winthrop Shaw Pittman, LLP

(57) ABSTRACT

A drum washing machine includes an elastic support mechanism elastically supporting a water tub. The support mechanism includes an oil damper and coil spring. The oil damper includes a cylinder having an opening, a tapered cap mounted so as to close the opening of the cylinder, and a piston rod extending through the tapered portion of the cap. The piston rod has one end connected to the piston and the other end on which a washer is mounted so as to be prevented from falling off. The coil spring has one end including a part with a smaller winding diameter than the other portion. The coil spring is disposed so that the piston rod extends through the coil spring such that the end with the smaller diameter is wound on the tapered portion of the cap. The other end of the coil spring is received by the washer.

5 Claims, 8 Drawing Sheets

FOREIGN PATENT DOCUMENTS

| | | |
|---|---|---|
| GB | 1 390 395 | 4/1975 |
| JP | 51-131077 | 9/1951 |
| JP | 52-015570 | 2/1952 |
| JP | 54-047374 | 4/1979 |
| JP | 11-253690 | 9/1999 |
| JP | 2001-212395 | 7/2001 |

* cited by examiner

DRUM-TYPE WASHING MACHINE WITH ELASTIC OIL DAMPER

This application is the PCT U.S. National Phase filing of International Application No. PCT/JP02/04868 filed May 20, 2002 and designating the United States, which claims priority from Japanese Application No. 2001-153890, filed May 23, 2001.

TECHNICAL FIELD

This invention relates to a drum washing machine provided with elastic support mechanisms for elastically supporting a water tub.

BACKGROUND ART

One type of drum washing machine comprises an outer cabinet, a water tub mounted in the cabinet, and a plurality of elastic support mechanisms. Each support mechanism comprises a coil spring provided on an upper portion of the wash tub for elastically suspending the water tub and an anti-vibration damper provided on a lower portion of the water tub for damping vibration of the water tub. A friction damper is generally used as the anti-vibration damper. The friction damper utilizes a frictional resistance produced by a piston slid in a cylinder. Thus, the above-mentioned drum washing machine necessitates spaces over and below the water tub in which the coil springs and the anti-vibration dampers are disposed respectively.

Another type of drum washing machine comprises a plurality of elastic support mechanisms each of which includes an anti-vibration damper in which the piston and coil spring are disposed in the cylinder. This type of drum washing machine can achieve a reduction in the size thereof since it requires no spaces in which the coil springs are disposed.

The foregoing friction damper includes the piston and a sliding face of the cylinder each of which requires a high level of precision. The frictional resistance between the piston and cylinder is susceptible of aged deterioration due to influences of wear or the like. Accordingly, the friction damper has a low reliability concerning a long time of service.

To overcome the foregoing problem, the applicant of the present application filed a patent application in Japan for the invention providing a drum washing machine including an elastic support mechanism in which a predetermined amount of damping oil is contained in a cylinder of an anti-vibration damper. The patent application was published under publication No. 2001-212395. Referring to FIG. 13, the elastic support mechanism 1 comprises an anti-vibration damper 5 including a double cylinder 2, a predetermined amount of damping oil 3 contained in the cylinder and a piston 4 disposed in the cylinder and having an orifice 4*a*. The mechanism further comprises a coil spring 6 which is disposed in a lower interior of the cylinder 2 so as to be located below the piston 4 as shown in FIG. 13. A piston rod 9 extends upward from the piston 4 through a central hole of a cap closing an upper opening of the cylinder 2. The piston rod 9 has an upper end held by a nut 12 on a tub mount 7 provided on a water tub (not shown) with a cushioning member 11 interposed therebetween. A rod 10 mounted on a lower end of the cylinder 2 is held by another nut 12 on a bottom plate 8 of the outer cabinet with another cushioning member 11 interposed therebetween.

In the above-described anti-vibration damper 5, a damping effect can be achieved by viscous resistance of the oil 3 passing through orifices 4*a* with vertical movement of the piston 4. Accordingly, the frictional resistance between the piston 4 and cylinder 2 is less susceptible of aged deterioration such that the service life of the damper can be improved.

However, the foregoing support mechanism 1 has the following deficiencies. The cap 13 is welded to the upper end of the cylinder 2 so that the cylinder is hermetically sealed. FIG. 13 shows a welded portion Y. The coil spring 6 needs to be maintained in a compressed state when the cap 13 is welded to the cylinder 2. This reduces an assembling efficiency.

Furthermore, specifications of the coil spring 6 including spring constant, wire diameter, outer diameter, number of turns, length in the natural state, etc. are set on the basis of load (initial load, maximum load) applied to the elastic support mechanism 1, location of the water tub in the outer cabinet, and the like. Since the coil spring 6 is disposed in the cylinder 2, the outer diameter and length of the coil spring 6 in the natural state need to be matched with an inner diameter and length of the cylinder 2. As a result, the degree of freedom in the design of the elastic support mechanism 1 is reduced.

Additionally, if the coil spring 6 disposed in the cylinder 2 should fail, the whole mechanism 1 would need to be replaced by a new one. This reduces the recycling efficiency.

DISCLOSURE OF THE INVENTION

Therefore, an object of the present invention is to provide a drum washing machine with an elastic support mechanism having improved assembling and recycling efficiencies and a high level of design freedom.

The present invention provides a drum washing machine comprising an outer cabinet, a water tub disposed in the outer cabinet, a generally drum-shaped rotating tub rotatably mounted in the water tub, and an elastic support mechanism provided inside the outer cabinet for elastically supporting the rotating tub, wherein the elastic support mechanism includes an oil damper further including a cylinder and a predetermined amount of damping oil contained in the cylinder, and a coil spring having two ends and mounted outside the cylinder so that the coil spring is substantially concentric with the cylinder; the cylinder includes a supporting portion for supporting one end of the coil spring; said one end of the coil spring includes a reduced diameter portion having a smaller diameter than the other portion of said one end of the coil spring, the reduced diameter portion being wound on the supporting portion of the cylinder; the supporting portion is formed on an outer periphery of the cylinder and the coil spring includes a part wound on the cylinder; and said other portion of the one end of the coil spring is constructed so as to be avoided abutting against the supporting portion.

Firstly, the coil spring is disposed outside the cylinder in the foregoing drum washing machine. Accordingly, since the shapes of the coil spring and the cylinder is allowed to be designed independently of each other, the design freedom can be improved. Secondly, the cylinder can more easily be closed. Thirdly, even when either oil damper or cylinder fails, only the failed one needs to be replaced. Consequently, the recycling efficiency can be improved. Additionally, the oil damper can be used commonly in a plurality of types of washing machines differing in the volume of the rotating tub although the specifications of the coil spring need to be changed. Consequently, a part of the elastic support mechanism can be standardized, which is advantageous in the production management.

Furthermore, the cylinder includes a supporting portion for supporting one end of the coil spring in the above-described construction. The size of the elastic support mechanism can be reduced since a distance between the end of the coil spring and the cylinder is completely reduced. Furthermore, in the foregoing construction, the one end of the coil spring includes a portion further including at least two coil turns closely adherent to each other, said portion being wound on the supporting portion of the cylinder. The portion of the coil spring including the coil turns closely adherent to each other exerts no spring force and accordingly does not expand and contract or flex. Consequently, a frictional sound, creak, etc. can be prevented from being produced between the end of the coil spring and the supporting portion of the cylinder.

The cylinder preferably has an end, and the oil damper preferably includes a piston provided in the cylinder and a piston rod mounted on the piston so as to extend through the end of the cylinder out of the cylinder, the piston rod extending through a space inside the coil spring. A space around a portion of the piston rod extending out of the cylinder is used for disposition of the coil spring. Accordingly, the disposition space for the elastic support mechanism can be reduced. Furthermore, since the piston rod extends through the space inside the coil spring, the coil spring can be prevented from being bent in a direction differing from the directions in which the coil spring expands and contracts.

The cylinder preferably includes a supporting portion for supporting one end of the coil spring. The size of the elastic support mechanism can be reduced since a distance between the end of the coil spring and the cylinder is completely reduced.

The one end of the coil spring preferably includes a portion further including at least two coil turns closely adherent to each other, said portion being wound on the supporting portion of the cylinder. The portion of the coil spring including the coil turns closely adherent to each other exerts no spring force and accordingly does not expand and contract or flex. Consequently, a frictional sound, creak, etc. can be prevented from being produced between the end of the coil spring and the supporting portion of the cylinder.

Furthermore, the one end of the coil spring includes a reduced diameter portion having a smaller diameter than the other portion of the coil spring, the reduced diameter portion being wound on the supporting portion of the cylinder. The portion of the coil spring other than the reduced diameter portion has a diameter larger than the reduced diameter portion. Consequently, noise can be prevented from being produced by the coil spring striking the cylinder when the coil spring expands and contracts.

The supporting portion is formed in the end of the cylinder and has a tapered cylindrical shape. This construction can prevent the coil spring and the supporting portion from rubbing against each other.

The supporting portion is formed on an outer periphery of the cylinder and the coil spring preferably includes a part wound on the cylinder. Since a part of the coil spring overlaps a part of the cylinder, the length of the elastic support mechanism can be reduced.

The elastic support mechanism preferably further includes a washer detachably mounted on the piston rod for supporting the other end of the coil spring. Consequently, the other end of the coil spring can easily be supported by the washer.

The coil spring preferably has a spring constant set on the basis of at least a load applied to the elastic support mechanism. Accordingly, the spring constant of the coil spring can be set so that the coil spring contracts by a predetermined distance when the foregoing load is applied to the elastic support mechanism. Consequently, the load can reliably be supported by the elastic support mechanism.

The coil spring preferably has a free length set on the basis of at least a resonance amplitude at an initial stage of a dehydration step and the load including at least a maximum volume of laundry accommodated in the rotating tub and wash water contained in the water tub. The load applied to the elastic support mechanism becomes maximum in a wash or dehydration step in each of which a maximum amount of laundry is accommodated in the rotating tub and a predetermined amount of wash water is contained in the water tub. Furthermore, the amplitude of the coil spring becomes maximum at the initial stage of the dehydration step. Moreover, a degree of dehydration is low with respect to the laundry at the initial stage of the dehydration step, whereupon the load applied to the elastic support mechanism is relatively large. Accordingly, when the free length of the coil spring is set in consideration of the resonance amplitude of the coil spring and a contraction length of the coil spring at the time the load is maximum. Consequently, the coil spring can be prevented from remaining contracted in the wash or dehydration step.

BEST MODE FOR ENFORCEMENT OF THE INVENTION

Figure 1:
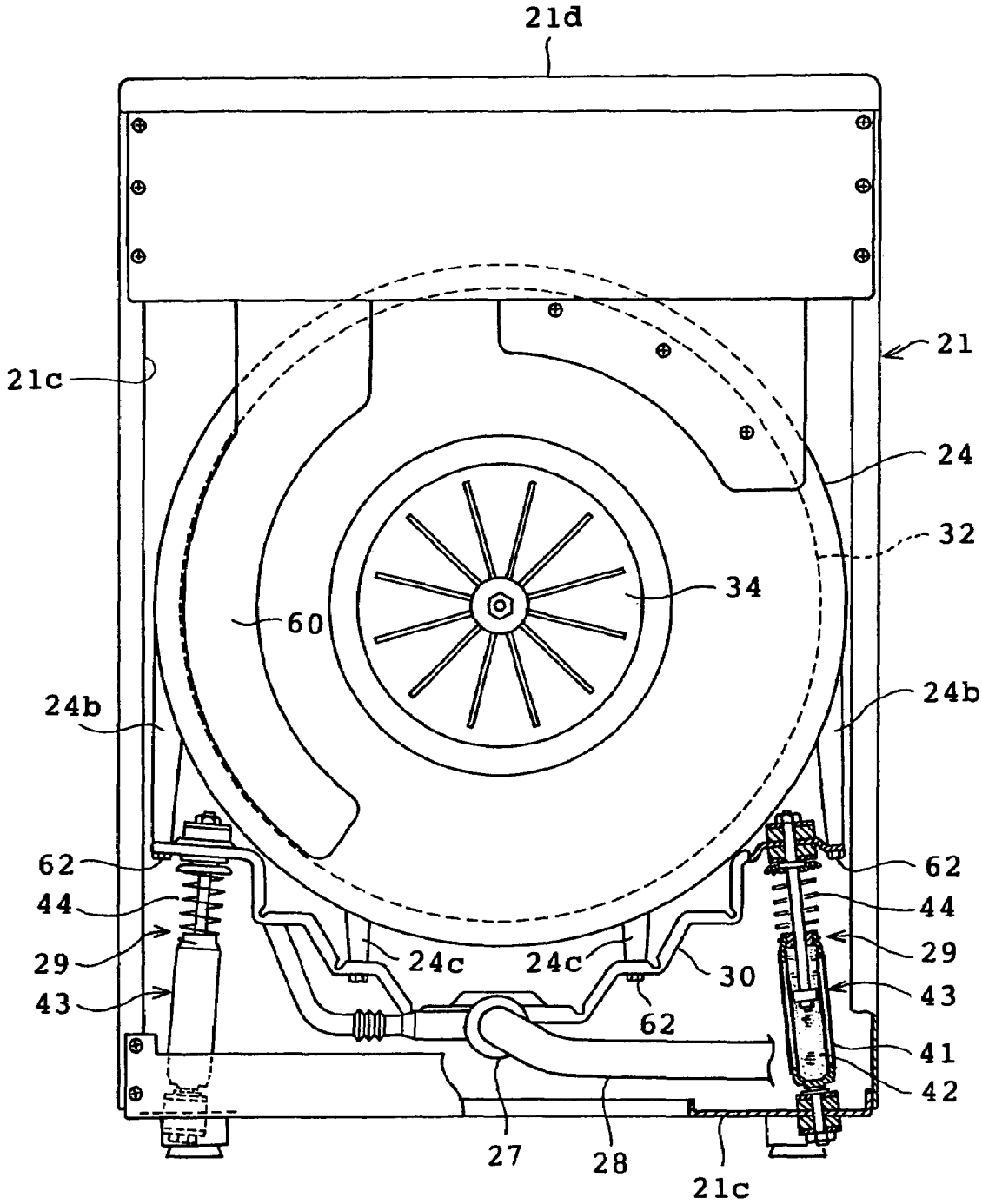
FIG. 1 is a rear view of a drum washing machine of a first embodiment in accordance with the present invention.
Figure 2:
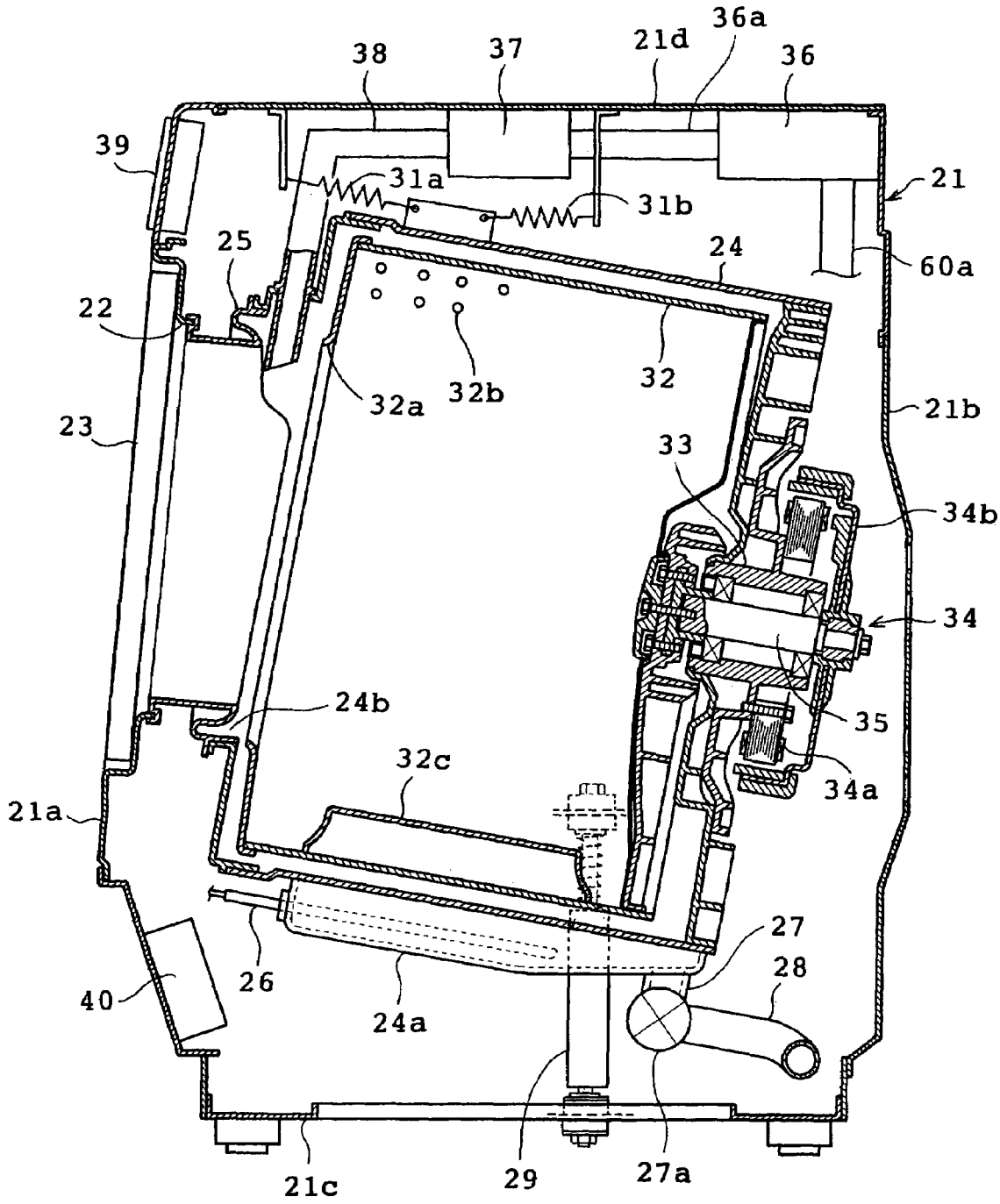
FIG. 2 is a longitudinal side section of the drum washing machine.

Several embodiments of the invention will be described with reference to the accompanying drawings. FIGS. 1 to 8 illustrate the drum washing machine of a first embodiment in accordance with the invention. Referring to FIGS. 1 and 2, the drum washing machine is shown as having a drying function. The drum washing machine includes a generally rectangular box-shaped outer cabinet 21 having a front panel 21*a* and a rear panel 21*b*. The front panel 21*a* has an access opening 22 through which laundry (not shown) is put into and taken out of a rotating tub 32. A door 23 is mounted on the front panel 21*a* to open and close the access opening 22. The rear panel 21*b* is removably mounted on the outer cabinet 21. When the rear panel 21*b* has been removed, a resultant opening defined by the outer cabinet 21 is adapted to serve as an inspection hole.

A drum-shaped stationary water tub 24 is mounted in the outer cabinet 21 so as to be inclined rearwardly downward. The water tub 24 has a front opening 24*b* to which bellows 25 are watertightly connected so that the opening 24*b* communicates with the access opening 22. The water tub 24 has a groove 24*a* formed in the bottom thereof. A heating element 26 is provided in the groove 24*a*. A drain hole 27 is formed in the rear of the groove 24*a*. A drain valve 27*a* is mounted in the drain hole 27. A drain hose 28 is connected to the drain hole 27.

The rotating tub 32 is generally drum-shaped and is rotatably mounted in the water tub 24. The rotating tub 32 serves as a wash, dehydration and drying tub. The rotating tub 32 is inclined in the same manner as the water tub 24. The rotating tub 32 includes a front formed with an opening 32*a* and a circumferential wall formed with a number of through holes 32*b*. The rotating tub 32 further has a plurality of baffles 32*c* formed on the inside of the circumferential wall thereof.

A bearing housing 33 is mounted on the central rear of the water tub 24 for supporting a rotational shaft 35 of an electric motor 34. The rotational shaft 35 has a front end extending through a hole (not shown) formed in the rear of the water tub 24 to be fixed to the central rear of the rotating tub 32. The motor 34 is a DC brushless motor, for example, and directly drives the rotating tub 32. The motor 34 includes a stator 34*a* and a rotor 34*b*. The stator 34*a* is fixed to an outer circumference of the bearing housing 33. The rotor 34*b* is fixed to a rear end of the rotational shaft 35 so as to cover the stator 34*a* from behind.

A generally duct-shaped dehumidifier 60 is provided on the rear of the water tub 24 so as to be located at the left hand of the motor 34 as viewed in FIG. 1. The dehumidifier 60 has a lower end communicating with the interior of the water tub 24. An electric heater 37 and a blower 36 are disposed before and behind in the upper interior of the outer cabinet 21. The dehumidifier 60 has an upper end communicating via a duct 60*a* with the blower 36. A duct 36*a* connects the blower 36 to the heater 37. A blowing duct 38 extending from the heater 37 has a distal end connected to the bellows 25.

A pair of elastic support mechanisms 29 elastically support the water tub 24 as shown in FIG. 1. The elastic support mechanisms 29 are mounted on a tub mount 30 and a bottom plate 21*c* of the outer cabinet 21. Furthermore, two extension springs 31*a* and 31*b* are provided between the top of the water tub 24 and a top panel 21*d* of the outer cabinet 21 for elastically supporting the water tub 24 for supplementing purposes. A tub assembly including the water tub 24, rotating tub 32, dehumidifier 60, bearing housing 33, motor 34 and the like applies load to each elastic support mechanism 29. The tub assembly thus serves as the aforesaid load.

An operation panel 39 is mounted on an upper portion of the front panel 21*a* of the outer cabinet 21 as shown in FIG. 2. A control device 40 is mounted on a lower inside of the front panel 21*a*. The control device 40 includes a microcomputer, RAM and ROM and stores a control program for controlling an overall washing and drying operation from a wash step to a drying step.

Figure 3:
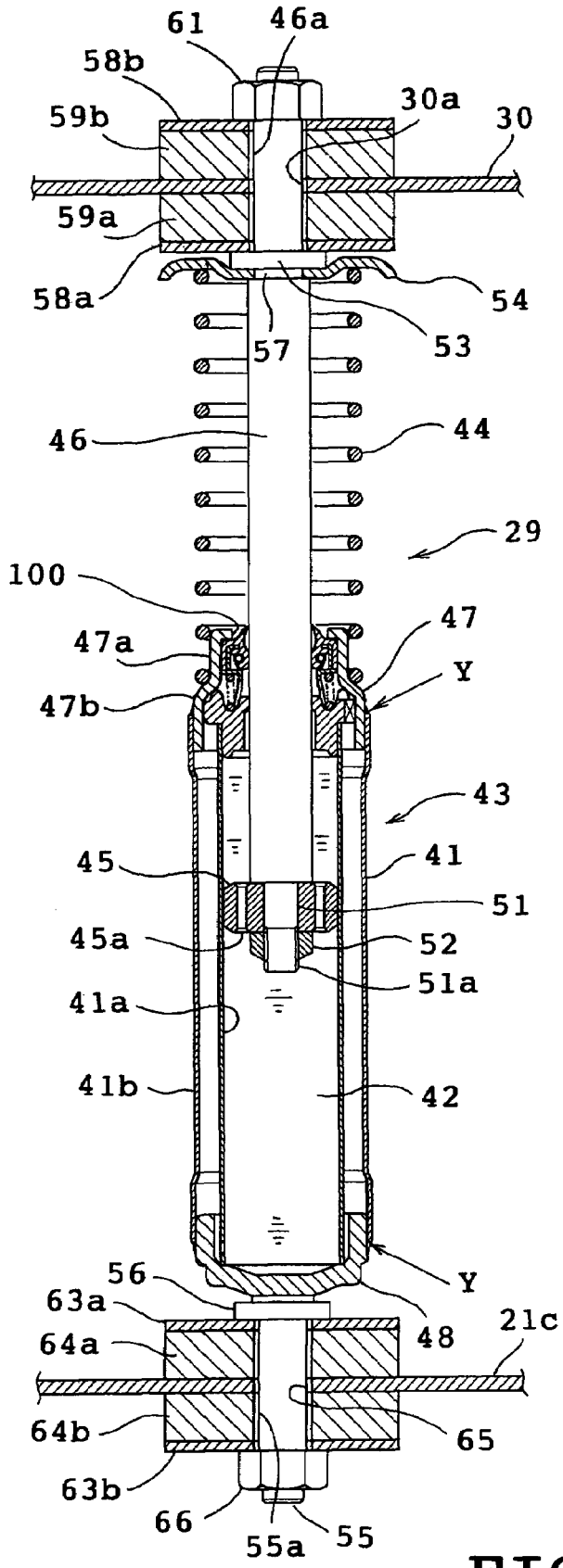
FIG. 3 is a longitudinal section of an elastic support mechanism and peripheral portion thereof.
Figure 4:
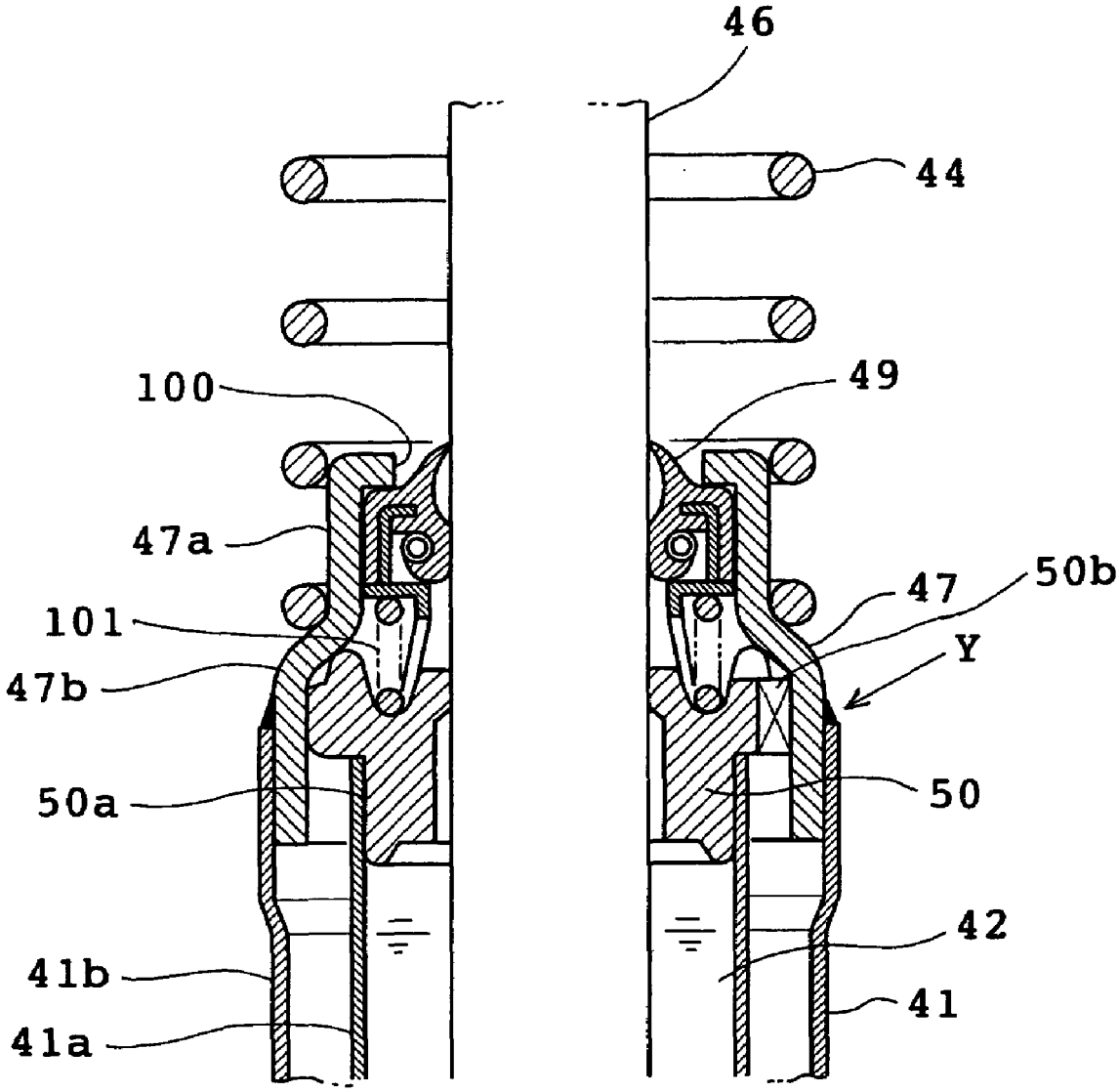
FIG. 4 is an enlarged section of a supporting portion for a coil spring of the elastic support mechanism.

Referring now to FIGS. 3 and 4, the construction of the elastic support mechanism 29 will be described in detail. The elastic support mechanism 29 includes an oil damper 43 and a coil spring 44. The oil damper 43 includes a double cylinder 41 containing a predetermined amount of damping oil 42. The coil spring 44 is mounted on an upper portion of the cylinder 41. The double cylinder 41 includes an inner cylinder 41*a* and an outer cylinder 41*b*, and has an upper opening closed by an upper cap 47 and a lower opening closed by a lower cap 48. Circumferential edges of the caps 47 and 48 are inserted into spaces between the inner and outer cylinders 41*a* and 41*b* respectively and then welded to the outer cylinder. Reference symbol Y in FIGS. 3 and 4 designates welded portions.

A piston rod 46 is inserted into the cylinder 41 through the upper opening thereof. A piston 45 is fixed to a lower end of the piston rod 46 so as to be located in the cylinder 41. The piston 45 has a plurality of orifices 45*a* formed therethrough. The upper cap 47 has an opening 100 through which the piston rod 46 extends upward as viewed in FIGS. 3 and 4. The piston 45 slides vertically along an inner circumferential surface of the inner cylinder 41*a*. The piston 45 is made of a sintered metal and has an outer circumferential surface which serves as a sliding surface and on which teflon is coated. The lower end of the piston rod 46 is provided with a reduced-diameter portion 51. A lower half of the reduced-diameter portion 51 is threaded to be formed into a male thread 51*a*. The piston 45 is fitted through the male thread 51*a* and thereafter, a nut 52 is screwed onto the male thread 51*a* so that the piston 45 is fixed to the piston rod 46.

The upper cap 47 includes an upper half portion 47*a* and a lower half portion 47*b* having a larger diameter than the upper half portion. An oil seal 49 is disposed in the upper half portion 47*a* for preventing the damping oil from leaking out of the cylinder 41. A metal rod support 50 is disposed in the lower half portion 47*b* for supporting the piston rod 46. The rod support 50 includes a lower protruding portion 50*a* fitted into the inner cylinder 41*a*. An outer circumference of the upper portion of the rod support 50 is formed so as to conform to the inner circumferential face of the upper cap 47. An air vent 50*b* is defined between an upper outer circumference of the rod support 50 and the inner circumferential face of the lower half portion 47*b* of the cap 47. A coil spring 101 is provided between the oil seal 49 and the rod support 50. The coil spring 101 urges the rod support 50 downward so that the piston rod 46 is supported with the oil seal 49 reliably sealing a gap between the rod and upper cap 47. In this state, the piston rod 46 is substantially concentric with the cylinder 41. The piston rod 46 has an integrally formed rod flange 53 on an upper portion thereof as shown in FIG. 3. The piston rod 46 further includes a portion which is located above the rod flange 53 and threaded into a male thread 46*a*. The piston rod 46 has a groove 57 formed under the rod flange 53.

Figure 5:
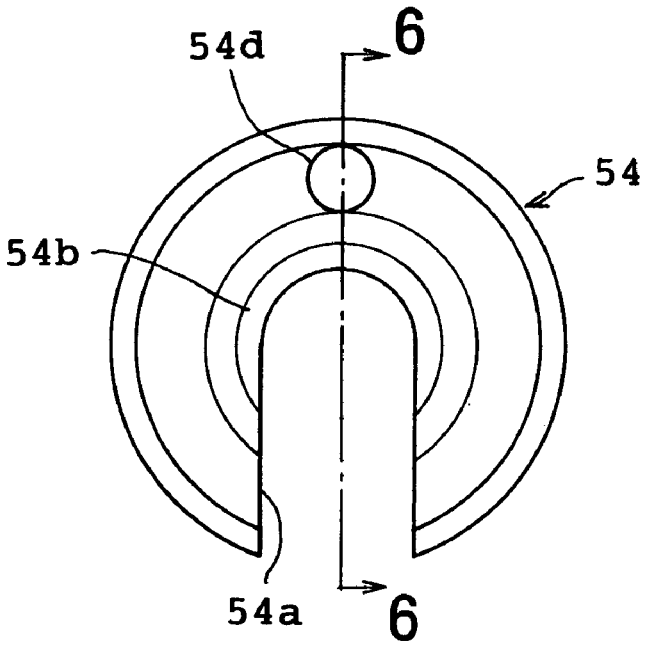
FIG. 5 is a plan view of a washer employed in the elastic support mechanism.
Figure 6:
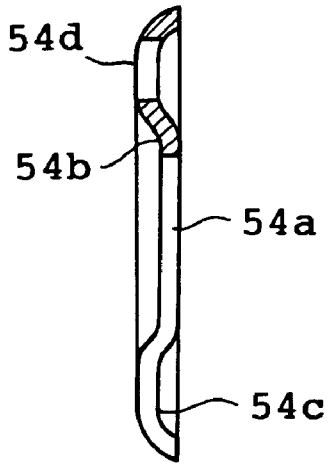
FIG. 6 is a longitudinal section taken along line 6-6 in FIG. 5.

A washer 54 has a larger diameter than the rod flange 53. The washer 54 is formed generally into a C-shape as shown in FIGS. 5 and 6 and fitted through a notch 54*a* with the groove 57. The washer 54 can easily be attached to and detached from the piston rod 46 sideways since it is C-shaped. Furthermore, the washer 54 has a recess 54*b* formed in an upper side thereof. The rod flange 53 enters the recess 54*b* when the washer 54 is fitted with the groove 57, whereupon the washer is prevented from displacement. Additionally, the washer 54 has a groove 54*c* formed along the outer circumference thereof in the lower side thereof. The groove 54*c* has a central hole 54*d*. The coil spring 44 is supported between the washer 54 and the upper cap 57 with the piston rod 46 extending through the coil spring. More specifically, the lower end of the coil spring 44 is wound on the upper half portion 47*a* of the upper cap 47. Accordingly, the upper cap 47 serves as a supporting portion in the invention. On the other hand, the upper end of the coil spring 44 is supported by the washer 54. At this time, one upper end turn of the coil spring 44 enters the groove 54*c* while its distal end is engaged with the hole 54*d*. As described above, the coil spring 44 is stably held between the washer 54 and the upper cap 47 so as to be substantially concentric with the cylinder 41.

Furthermore, a lower rod 55 extends downward from the lower end of the cylinder 41 so as to be substantially concentric with the latter. The rod 55 has a rod flange 56 integrally formed on an upper portion thereof. The rod 55 includes a male thread 55*a* located below the rod flange 56.

The foregoing elastic support mechanism 29 is mounted between the water tub 24 and the outer cabinet 21 in the following manner. Firstly, a washer 58*a* and a cushioning member 59*a* are fitted with the upper end of the piston rod 46 in turn before the tub mount 30 is attached to the lower portion of the water tub 24. Thereafter, the upper end of the piston rod 46 is inserted through a mounting hole 30*a*. A cushioning member 59*b* and a washer 58*b* are fitted in turn with a portion of the rod 46 projecting upward from the tub mount 30. A nut 61 is thereafter screwed onto the male thread 46*a*. As a result, the piston rod 46 is fixed to the tub mount 30 with the cushioning members 59*a* and 59*b* fitted with the rod at opposite sides of the tub mount.

The tub mount 30 is then fixed to bosses 24*b* and 24*c* by means of a bolt 62 as shown in FIG. 1. A washer 63*a* and a cushioning member 64*a* are fitted in turn with the lower rod 55 and thereafter, the lower end of the rod 55 is inserted through a mounting hole 65 of the bottom plate 21*c* of the outer cabinet 21. A cushioning member 64*b* and a washer 63*b* are fitted with a portion of the rod 55 projecting downward from the bottom plate 21*c* in turn. Thereafter, a nut 66 is screwed onto the male thread 55*a*, whereby the lower rod 55 is fixed to the bottom plate 21*c* with the cushioning members 64*a* and 64*b* fitted with the rod at opposite sides of the bottom plate.

The elastic support mechanism 29 mounted between the water tub 24 and the outer cabinet 21 as described above elastically supports the foregoing tub assembly composed of the tubs 24 and 32 and the like. The coil spring 44 has a spring constant set so as to be compressed a predetermined length when a weight (initial weight) of the tub assembly is applied to the coil spring under the condition where no laundry is accommodated in the rotating tub 32. Consequently, the tub assembly can be supported stably by the elastic support mechanism 29.

Furthermore, the coil spring 44 has a free length set on the basis of a dimension of compression thereof in a case where the weight (maximum weight) of the tub assembly is applied to the coil spring when a maximum volume of laundry is accommodated in the rotating tub and a predetermined amount of wash water is stored in the water tub 24, a dimension of compression thereof in a case where the initial weight of the assembly is applied to the coil spring, and a resonance amplitude at an initial stage of a dehydration step. Consequently, the coil spring 44 can be prevented from interference between turns thereof in the dehydration step and adherence between turns thereof in the wash or rinse step.

Each of the foregoing cushioning members 59*a*, 59*b*, 64*a* and 64*b* is made of butyl rubber, for example. The cushioning members 64*a* and 64*b* at the bottom plate 21*c* side has a lower hardness than the cushioning members 59*a* and 59*b* at the water tub 24 side, so that an amount of vibration transmitted from the elastic support mechanism 29 to the outer cabinet 21 is reduced.

Upon start of a STANDARD course, the drum washing machine sequentially executes the wash, rinse, dehydration and drying steps. In the wash and rinse steps, laundry is accommodated in the rotating tub 32 and a predetermined amount of wash water is stored in the water tub 24. The tub 32 is rotated at low speeds (about 50 rpm, for example) alternately in opposite directions by the motor 34. With rotation of the tub 32, the laundry therein is raised upward together with the water by the baffles 32*c* and thereafter falls downward thereby to be agitated. This agitating operation is repeated. Accordingly, the elastic support mechanism 29 is subjected to a load of at least addition of a weight of laundry and a weight of wash water to the weight of the assembly in each of the wash and rinse steps. The piston rod 46 is pressed downward such that the piston 45 is moved downward in the cylinder 41. However, the movement of the piston 45 is damped by a flow or viscosity resistance of the damping oil 42 flowing through the orifices 45*a*.

Furthermore, the coil spring 44 is compressed when subjected to the load of the tub assembly. As described above, however, the adherence of coil turns of the coil spring 44 is prevented even when the weight of the assembly becomes maximum. Accordingly, even when the tub assembly vertically vibrates with the agitating operation, the vibration is absorbed by the elastic force of the coil spring 44. Consequently, the vibration of the tub assembly can be prevented from transmitting to the outer cabinet 21.

The tub 32 is rotated at high speeds (about 1000 rpm, for example) in one direction by the motor 34 in the dehydration step. Accordingly, the tub 32 is rotated while laundry therein is adherent to the inner circumferential face of the tub, whereby the laundry is centrifugally dehydrated. The rotational speed of the tub 32 is low at the time of start of the motor 34 and is increased with lapse of time. The coil spring 44 vibrates to a large extent when the rotational speed of the tub 32 exceeds a resonant point in the course of increase. Moreover, laundry has a low dehydration degree at an initial stage of the dehydration step and accordingly contains a relatively large amount of water. As described above, however, the free length of the coil spring 44 is set so that interference is prevented between coil turns of the coil spring. Consequently, an amount of noise produced can be reduced. Furthermore, the vibration caused by the tub assembly is absorbed by the elastic support mechanism 29.

In the drying step, the tub 32 is also rotated at low speeds (about 50 rpm, for example) alternately in opposite directions by the motor 34 and the blower 36 and heater 37 are energized. Furthermore, a predetermined amount of water is poured into the dehumidifier 60 from above. As a result, the blower 36 supplies air to the heater 37 so that hot air is supplied through the blowing duct 38 into the tubs 24 and 32. The hot air absorbs water content from the laundry in the tub 32, flowing into the dehumidifier 60. The air flown in the dehumidifier 60 is cooled and condensed by the water poured into it thereby to be dehumidified. The dehumidified air is thereafter returned through the blower 36 and heater 37 into the tub 32. The laundry in the tub 32 is dried by the above-described circulation of air.

The elastic support mechanism 29 includes the oil damper 43. Consequently, since the elastic support mechanism 29 is less affected adversely by aged deterioration, the tub assembly can stably be supported for a long period of time. Furthermore, since the coil spring 44 is disposed outside the cylinder 41, the shapes of the coil spring and the cylinder can be designed independently of each other, and the upper cap 47 can be welded to the outer cylinder 41*b* easily and reliably. Moreover, the coil spring 44 is disposed above the cylinder 41 so that the piston rod 46 extends through the inner space of the coil spring. Accordingly, since a space around a portion of the piston rod 46 extending out of the cylinder 41 is used for disposition of the coil spring 44. Accordingly, the disposition space for the elastic support mechanism can be reduced. Furthermore, since the piston rod 46 extends through the space inside the coil spring 44, the coil spring can be prevented from being bent in a direction differing from the directions in which the coil spring expands and contracts.

The oil damper 43 and the coil spring 44 can easily be separated from each other. Accordingly, even when either oil damper 43 or coil spring 44 fails, the overall elastic support mechanism 29 need not be scrapped and only the failed one needs to be replaced. Consequently, the recycling efficiency of the elastic support mechanism 29 can be improved. Additionally, the oil damper 43 can be used as a common component in a plurality of types of washing machines differing in the specifications of the coil spring. Consequently, since the common component can be used, the elastic support mechanism 29 is advantageous in the production management.

The lower end of the coil spring 44 is directly mounted on the upper cap 47 of the cylinder 41. The construction of the elastic support mechanism 29 can be simplified since a part or parts used for supporting the lower end of the coil spring 44 are eliminated. Furthermore, the piston rod 46 and the lower rod 55 are mounted on the water tub 24 and the outer cabinet 21 together with the cushioning members 59*a*, 59*b* and 64*a*, 64*b*, respectively. Accordingly, transverse swinging (vibration) of the tub 24 transmitted to the elastic support mechanism 29 is reduced. Consequently, the junction between the upper cap 47 and the outer cylinder 41*b* can be prevented from breakage due to an excessive external force applied to the boundary between the cylinder 41 and the piston rod 46. Additionally, the hardness of the cushioning members 64*a* and 64*b* disposed at the outer cabinet 21 side is lower than that of the cushioning members 59*a* and 59*b*. Consequently, a further reduction can be achieved in the transmission of vibration to the outer cabinet 21 side.

Figure 7:
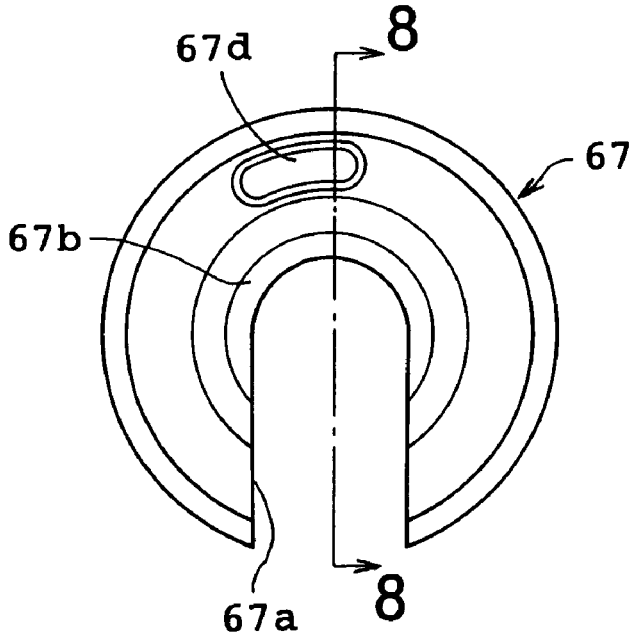
FIG. 7 is a view similar to FIG. 5, showing a washer employed in the elastic support mechanism in the drum washing machine of a second embodiment in accordance with the present invention.
Figure 8:
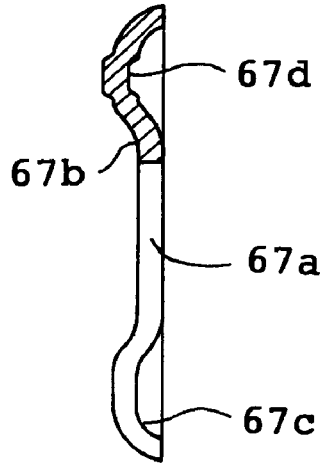
FIG. 8 is a longitudinal section taken along line 8-8 in FIG. 7.

FIGS. 7 and 8 illustrate a second embodiment of the invention. In the second embodiment, identical or similar parts are labeled by the same reference symbols as those in the first embodiment. Only the difference of the second embodiment from the first embodiment will be described. In the second embodiment, a washer 67 is fitted with the piston rod 46 instead of the washer 54. The washer 67 is also formed generally into a C-shape as shown in FIGS. 7 and 8 and fitted through a notch 67*a* with the groove 67*c*. The washer 67 can easily be attached to and detached from the piston rod 46 sideways since it is C-shaped. The groove 67*c* has a generally elliptic recess 67*d* formed in the circumferentially central portion thereof.

In the second embodiment, an upper end turn of the coil spring 44 assumes a position in the groove 67*c* with the distal end thereof engaged with the recess 67*d*. Accordingly, the coil spring 44 can stably be held between the washer 67 and the upper cap 47. The other construction of the drum washing machine in the second embodiment is the same as that in the first embodiment. The same effect can accordingly be achieved from the second embodiment as from the first embodiment.

Figure 9:
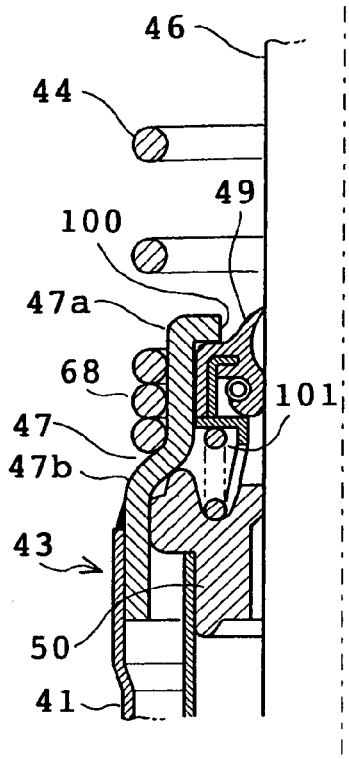
FIG. 9 is an enlarged section of a left-hand part of the supporting portion supporting the coil spring of the elastic support mechanism in the drum washing machine of a third embodiment in accordance with the present invention.
Figure 10:
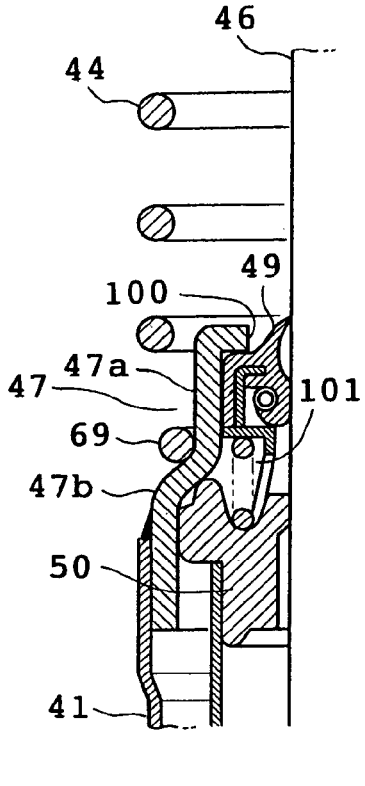
FIG. 10 is a view similar to FIG. 9, showing the left-hand part of the supporting portion supporting the coil spring of the elastic support mechanism in the drum washing machine of a fourth embodiment in accordance with the present invention.
Figure 11:
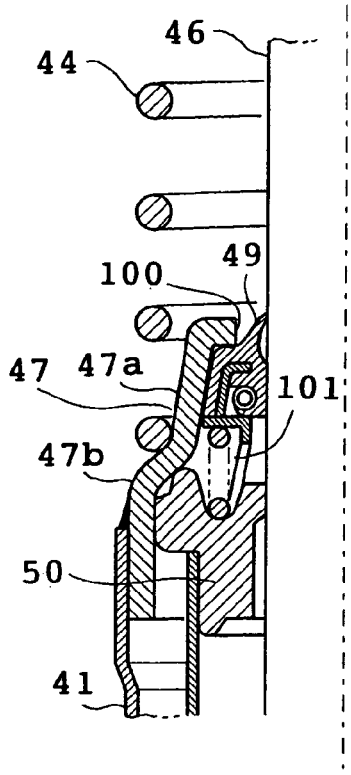
FIG. 11 is a view similar to FIG. 9, showing the left-hand part of the supporting portion supporting the coil spring of the elastic support mechanism in the drum washing machine of a fifth embodiment in accordance with the present invention.

FIGS. 9 to 11 illustrate third to fifth embodiments of the invention respectively. Only the difference of each of the third to fifth embodiments from the first embodiment will be described. Each of the third to fifth embodiments differs from the first embodiment in a mounting structure for the coil spring 44 on the upper cap 41. More specifically, in the third embodiment, the lower end of the coil spring 44 includes a closely adherent portion 68 composed of, for example, three coil turns closely adherent to one another as shown in FIG. 9. The closely adherent portion 68 is wound on an upper portion 47*a* of the upper cap 47. Since the closely adherent portion 68 imparts no spring force, it is not expanded nor contracted even when the vibration caused by the water tub 24 expands and contracts the overall coil spring 44. Consequently, a frictional sound, creak, etc. can be prevented from being produced between the closely adherent portion 68 and the upper cap 47.

In the fourth embodiment as shown in FIG. 10, the coil spring 44 includes one lower end turn serving as a reduced-diameter turn 69 having a smaller diameter than the other portion thereof. The reduced-diameter turn 69 is wound on the upper half portion 47*a* of the upper cap 47. Accordingly, the portion of the coil spring which is not wound on the upper half portion 47*a* has a larger diameter than the upper half portion. Even when the vibration caused by the water tub 24 expands and contract the coil spring 44, it can be prevented from interfering with and rubbing against the upper half portion 47*a*.

In the fifth embodiment as shown in FIG. 11, the upper half portion 47*a* of the upper cap 47 is formed into a tapered cylindrical shape. One lower end turn of the coil spring 44 is wound on a portion having the largest diameter in the upper half portion 47*a* or the boundary between the upper and lower half portions. In this construction, the portion of the coil spring 44 other than the portion wound on the upper half portion 47*a* has a larger diameter than the upper half portion. Consequently, even when the coil spring is expanded and contracted, the coil spring 44 can be prevented from interfering with and rubbing against the upper half portion 47*a*.

Figure 12:
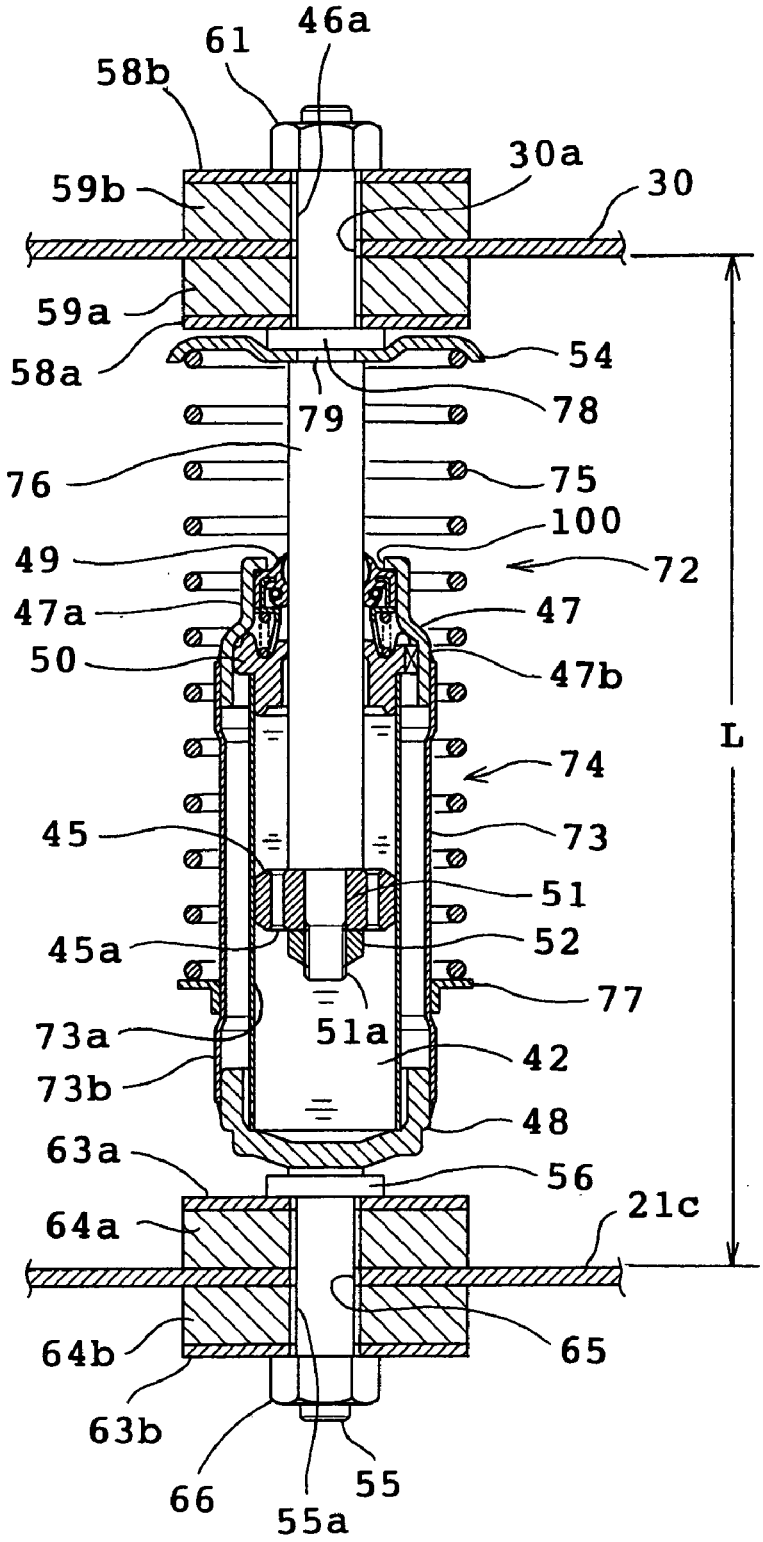
FIG. 12 is a view similar to FIG. 3, showing an elastic support mechanism and peripheral portion thereof in the drum washing machine of a sixth embodiment in accordance with the present invention.
Figure 13:
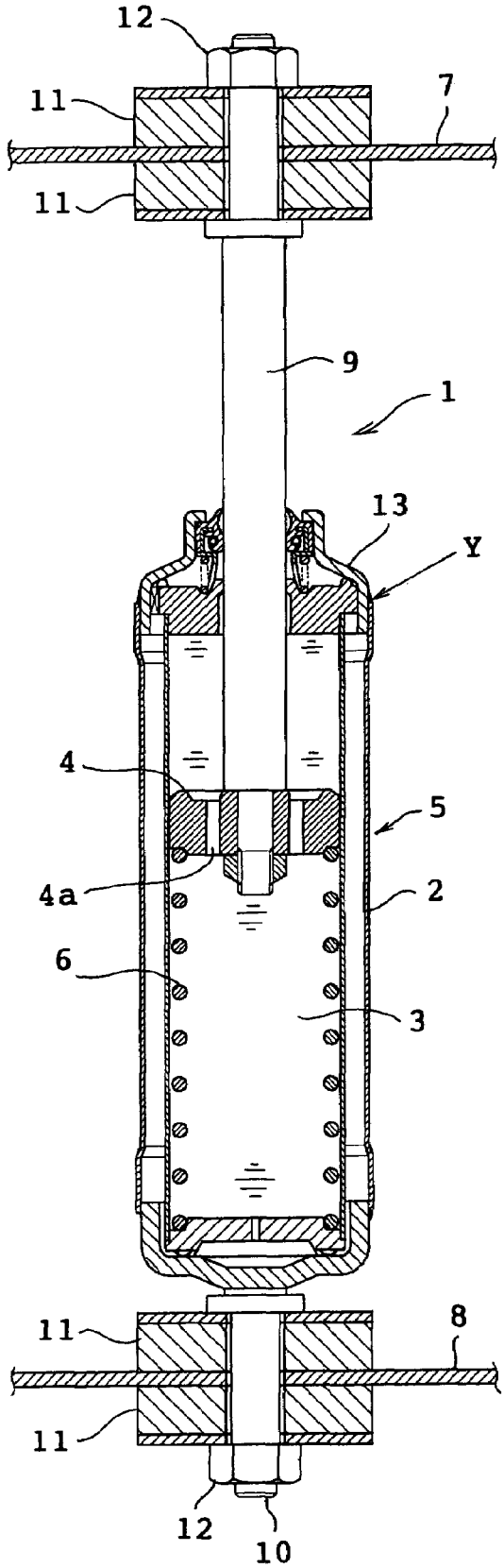
FIG.13 PRIOR ART
FIG. 13 is a view similar to FIG. 3, showing a conventional elastic support mechanism.

FIG. 12 illustrates a sixth embodiment of the invention. Only the difference of the sixth embodiment from the first embodiment will be described. In the sixth embodiment, the elastic support mechanism 72 includes an oil damper 74 and a coil spring 75. The oil damper 74 includes a double cylinder 73 containing a predetermined amount of damping oil 42. The coil spring 75 is mounted outside the oil damper 74. The cylinder 73 has a larger length than the cylinder 41 in the first embodiment. The other construction of the oil damper 74 is substantially the same as that of the oil damper 43 in the first embodiment. More specifically, the cylinder 73 includes an inner cylinder 73*a* and an outer cylinder 73*b*, and has an upper opening closed by the upper cap 47 and a lower opening closed by the lower cap 48.

A piston rod 76 is inserted into the cylinder 73 through the upper opening thereof. The piston 45 is fixed to a lower end of the piston rod 76 so as to be axially slid on the inner surface of the cylinder 73. The piston rod 76 is shorter than the piston rod 46 according to the cylinder 73 which is also shorter than the cylinder 41. The piston rod 76 has an integrally formed rod flange 78 on an upper portion thereof. The piston rod 76 has a groove 79 formed under the rod flange 53. The washer 54 is fitted with the groove 79. An annular spring bracket 77 is welded or otherwise fixed to the lower outer circumferential surface of the outer cylinder 73*b*. The coil spring 75 is held between the bracket 77 and the washer 54 with the piston rod 76 and the cylinder 73 extending through the inside space of the coil spring.

The length L of the elastic support mechanism 72 from the tub mount 30 to the bottom plate 21*c* can be reduced since the coil spring 75 is disposed so that a part thereof is located around the cylinder 73. Consequently, a space between the water tub 24 and the bottom plate 21*c* of the outer cabinet 21 is reduced such that the outer cabinet 21 can be rendered smaller. The other construction of the elastic support mechanism in the sixth embodiment is substantially the same as that in the first embodiment. Accordingly, the same effect can be achieved from the sixth embodiment as from the first embodiment.

The closely adherent portion including the closely adherent coil turns may be provided at the lower end of the coil spring 75 in the sixth embodiment.

The water tub and rotating tub may be disposed horizontally although these tubs are inclined rearwardly downward in the foregoing embodiments. Furthermore, a single cylinder may be used instead of the double cylinder.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

INDUSTRIAL APPLICABILITY

As obvious from the foregoing, the drum washing machine in accordance with the present invention has usability as a small-sized household drum washing machine with a high design freedom and a high recycling efficiency and is particularly suitable for a plurality of types of washing machines differing in the volume of the rotating tub.

What is claimed is:

1. A drum washing machine comprising:

an outer cabinet;

a water tub disposed in the outer cabinet;

a generally drum-shaped rotating tub rotatably mounted in the water tub; and an elastic support mechanism, provided inside the outer cabinet, and configured to elastically support the water tub, the elastic support mechanism including an oil damper, and a coil spring, wherein, the oil damper includes:

a cylinder which accommodates a piston and oil and has an end formed with an opening, the opening being provided with a tapered cap, having a tapered portion, so as to close the opening of the cylinder, and a piston rod configured to extend through the tapered portion of the cap, the piston rod having one of two ends connected to the piston and the other end having a washer so as to be prevented from falling off; and wherein the coil spring includes:

having one of two ends contain a portion with a smaller winding diameter than the other portion thereof, the coil spring being disposed so that the piston rod extends therethrough such that the end with the smaller winding diameter is wound on the tapered portion of the cap, whereas the other end of the coil spring is received by the washer, whereby the coil spring exerts an elastic force between the cylinder and the piston.

2. The drum washing machine according to claim 1, wherein said one end of the coil spring includes a portion further including at least two coil turns closely adherent to each other, said portion being wound on the supporting portion of the cylinder.

3. The drum washing machine according to claim 1, wherein the washer is detachably attached to the piston rod.

4. The drum washing machine according to claim 1, wherein the coil spring has a spring constant set on the basis of at least a load applied to the elastic support mechanism.

5. The drum washing machine according to claim 1, wherein the coil spring has a free length set on the basis of at least a resonance amplitude at an initial stage of a dehydration step and the load including at least a maximum volume of laundry accommodated in the rotating tub and wash water contained in the water tub.

* * * * *

UNITED STATES PATENT AND TRADEMARK OFFICE

CERTIFICATE OF CORRECTION

PATENT NO. : 7,310,978 B2
APPLICATION NO. : 10/332961
DATED : December 25, 2007
INVENTOR(S) : Hisano It is certified that error appears in the above-identified patent and that said Letters Patent is hereby corrected as shown below:

On Title Page Item (54) and Col 1, Line 1-2

"DRUM-TYPE WASHING MACHINE WITH ELASTIC OIL DAMPER" should read --DRUM WASHING MACHINE--

Signed and Sealed this

Twenty-ninth Day of April, 2008

JON W. DUDAS
*Director of the United States Patent and Trademark Office*